United States Patent [19]

Brechbuhler

[11] 4,010,586

[45] Mar. 8, 1977

[54] METHOD FOR THE MANUFACTURE OF REINFORCEMENT MEMBERS AND MEMBER MANUFACTURED BY THE METHOD

[75] Inventor: Fritz W. Brechbuhler, Koniz, Switzerland

[73] Assignee: Gebr. Zehtner AG (Armierungs-Unternehmung), Bern, Switzerland

[22] Filed: Feb. 12, 1975

[21] Appl. No.: 549,204

[30] Foreign Application Priority Data

Feb. 27, 1974 Switzerland ..... 002872/74

[52] U.S. Cl. ..... 52/309.16; 52/378

[51] Int. Cl.[2] ..... E04C 1/00

[58] Field of Search ..... 52/368, 637, 376, 699, 52/701, 712, 414, 98–100, 309, 569, 334, 378; 264/46.7

[56] References Cited

UNITED STATES PATENTS

| | | | |
|---|---|---|---|
| 1,715,743 | 6/1929 | Duggan | 52/712 |
| 1,727,258 | 9/1929 | Tucker | 52/378 X |
| 1,767,065 | 6/1930 | Goldsmith | 52/699 X |
| 2,083,781 | 6/1937 | Groves | 52/712 X |
| 3,555,131 | 1/1971 | Weismann | 264/46.7 |
| 3,778,949 | 12/1973 | Hellerich | 52/309 |
| 3,884,004 | 5/1975 | Douma | 52/309 |

FOREIGN PATENTS OR APPLICATIONS

| | | | |
|---|---|---|---|
| 719,064 | 10/1965 | Canada | 52/309 |

*Primary Examiner*—Ernest R. Purser
*Assistant Examiner*—Carl D. Friedman
*Attorney, Agent, or Firm*—Ulle C. Linton

[57] ABSTRACT

A method for the manufacture of reinforcement members, in which steel rods are first bent into a U shape and the two arms of the U-shaped piece are then bent off at right angle, at a particular distance from the cross bar of the U. These steel rods are placed at preselected intervals of the U-shaped portion and with their bent-off arms lowermost, into a trough-shaped basin with outward sloping side walls. A liquid foam material is then brought into the basin so that the preshaped reinforcing rods will be immersed with their bent-off arms in the solidified foam material, while the brackets project with their cross bar from the foam material.

1 Claim, 5 Drawing Figures

Figure 1:
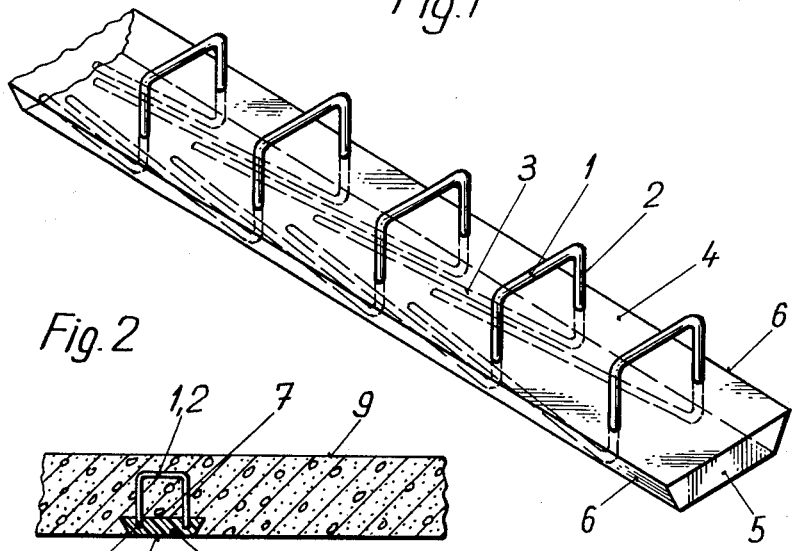

METHOD FOR THE MANUFACTURE OF REINFORCEMENT MEMBERS AND MEMBER MANUFACTURED BY THE METHOD

The invention relates to the manufacture of reinforcement members and a member manufactured by this method.

To construct concrete walls in a rationalised manner one uses largesize planking. A disadvantage in this process is that the main loadcarrying walls must be recessed for the connection of partition walls, stairs and intermediate floor. This operation is complicated, timeconsuming, and causes relatively high cost.

The problem was, therefore, to avoid this operation by fitting prefabricated reinforcement members to the plain planking of the main wall, the joining-up of partition walls, stairs and intermediate floors being already prepared at the same time. In this case, the reinforcing steel rods are already concreted into the main wall so that, for the adjoining walls etc., they merely have to be bent away.

The method for the manufacture of reinforcement members according to the invention is characterised in that, for reinforcement purposes, steel rods are first bent into a U shape, and the two arms of the U-shaped piece, at a particular distance from the cross bar of the U, are then bent into a right angle, that these bent steel rods are placed at preselected intervals of the U-shaped portion, with their bent-away arms lowermost, into a trough-shaped basin with outward sloping side walls, and a liquid foam material is then brought into the basin so that the preshaped reinforcing rods will be immersed with their bent arms in the solidified foam material while the U-shaped portion stands proud of the foam material.

The invention also relates to a reinforcement member manufactured by this method. This member is characterised in that it presents a prismatic body of foam material of an isosceles trapezoidal cross-section from whose wider parallel side steel brackets of reinforcing rods project at right angle, while along the narrower parallel side of the foam-material body, i.e. adjacent to its surface, bent-off arms of the reinforcing rods are embedded.

The drawing shows a stage during the process of manufacture of a reinforcement member, also the application of a reinforcement member for the connection of a partition wall to a main wall. There are shown in FIG. 1, in a perspective view, the place of the prebent steel rods into a specially shaped trough, FIG. 2, in a cross-section, a reinforcement member concreted into a main wall, FIG. 3, in a side elevation, a reinforcement member, concreted in position, with some of the reinforcement rods bent away, FIG. 4 a cross-section of FIG. 3, FIG. 5 a ground plan of a main wall with a partition wall connected to it.

Figure 2:
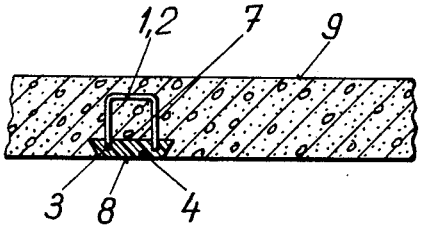

By the method for the manufacture of reinforcement members, the steel rods 1, 2, 3, intended as reinforcement, are bent into a U shape so that brackets 1, 2 are formed (FIG. 1). Then, the two arms 2 of the bracket are bent, at a particular distance from the cross bar 1, into a right angle so that the arms 3 will be found in a position convergent to each other. The thus preshaped steel rods 1, 2, 3 are now placed at preselected intervals of the brackets, and with the arms 3 lowermost, into a trough-type basis 5. The latter presents outwardly sloping side walls 6. After this, liquid foam material of Polyurethane is poured into the basin 5, which solidifies to form a carrier body 4. The bent-off arms 3 will be in a position adjacent to the bottom side of the basin 5 while the brackets 1, 2 project from the foam-material carrier body 4.

The two arms 3 can almost be bent at right angle to the plane described by the cross bar 1 and its two adjoining arm portions 2 (as shown in FIG. 1). But they may also be arranged almost in the described plane so that the bent-off rods 1, 2, 3 form an Omega configuration.

The reinforcement members 1 to 3, manufactured by this method, are provided with the carrier body 4 of foam material, which presents an isosceles trapezoidal cross section. From the wider side 7 of the two parallel sides 7, 8 project at right angle the steel brackets 1, 2 of the reinforcing rods 1, 2, 3. Along the narrower side 8 of the two parallel sides 7, 8 are the bent-off arms 3 embedded in the carrier body 4 of foam material. The latter is proposed to be approximately 1.3 meters long.

Figure 3:
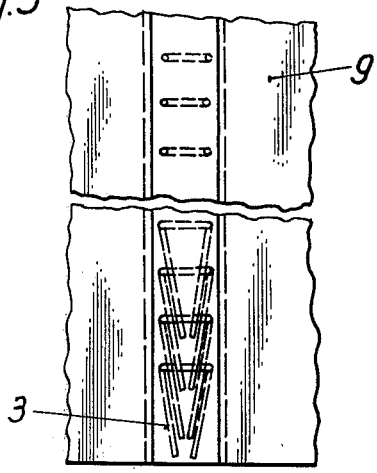
Figure 4:
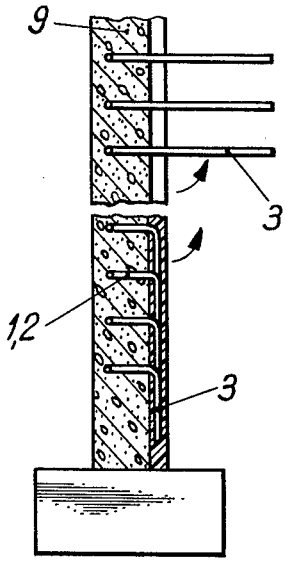
Figure 5:
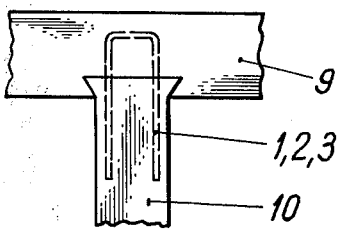

In application of the reinforcement member 1 to 4 same is fitted to the planking before a main wall 9 is concreted. The brackets 1, 2 will then remain firmly anchored in the completed wall (FIG. 2) while the carrier body 4 of foam material will be found adjacent to the wall surface. Before a connecting wall 10 is constructed. the foam-material body 4 is excavated from the main wall 9, and the exposed arms 3 will be bent outward (FIGS. 3, 4). Through the reinforcing rods 1, 2, 3, also through the dovetail portion produced by the trapezoidal cross-section of the foam-material body 4, the adjoining wall 10 is firmly connected to the main wall 9 (FIG. 5).

In this way reinforced partition walls, stairs, lift shafts, intermediate floors and silo ceilings, can in an advantageous manner be connected to the main walls. The scratching-out of the foam material is in no way comparable to the tedious, laborious, operation of recessing the main walls.

I claim:

1. A reinforcing member for connecting portions of contiguous structural parts comprising a prismatic body of synthetic foam having an isoceles trapezoidal cross-section, and reinforcing irons each of a U-shaped configuration and having an arch extending at right angles from the widest face of said body and the legs of each iron being bent and embedded in said body in proximity to the narrowest face of said body.

* * * * *